US005635056A

United States Patent [19]

Brons et al.

[11] Patent Number: 5,635,056

[45] Date of Patent: Jun. 3, 1997

[54] CONTINUOUS IN-SITU PROCESS FOR UPGRADING HEAVY OIL USING AQUEOUS BASE

[75] Inventors: Glen Brons, Phillipsburg, N.J.; Ronald D. Myers, Calgary, Canada

[73] Assignee: Exxon Research and Engineering Company, Florham Park, N.J.

[21] Appl. No.: 433,907

[22] Filed: May 2, 1995

[51] Int. Cl.[6] ..... C10G 29/20

[52] U.S. Cl. ..... 208/227; 208/229; 208/249; 208/244; 208/235

[58] Field of Search ..... 208/235, 227, 208/229, 249, 244

[56] References Cited

U.S. PATENT DOCUMENTS

| | | | |
|---|---|---|---|
| 3,185,641 | 5/1965 | Cowden | 208/226 |
| 3,440,164 | 4/1969 | Aldridge | 208/215 |
| 3,449,242 | 6/1969 | Mattox et al. | 208/227 |
| 3,791,966 | 2/1974 | Bearden | 208/208 |
| 4,163,043 | 7/1979 | Dezael et al. | 423/231 |
| 4,310,049 | 1/1982 | Kalvinskas et al. | 166/267 |
| 4,343,323 | 8/1982 | Kessick et al. | 137/13 |
| 4,437,980 | 3/1984 | Heredy et al. | 208/235 |
| 4,566,965 | 1/1986 | Olmstead | 208/208 R |
| 4,927,524 | 5/1990 | Rodriguez et al. | 208/131 |
| 5,160,045 | 11/1992 | Falkiner et al. | 210/634 |

OTHER PUBLICATIONS

A. Yu Adzhiev, et al, Neft Khoz, 1986, (10), 53–57.

L. P. Shulga, et al, Tr Grozn Neft Nauch–Issled Inst. 1972, (25), 19–26.

E. D. Burger, et al, 170th ACS Natl Meet (Chic Aug. 24–29, 1975) ACS Div. Pet Chem Prepr V20 N. 4, 765–75 (Sep. 1975) (2271005 APILIT).

La Count, et al, J. Org Chem, V42 No. 16, 1977, 2751–2754.

Yamaguchi, et al, Chibakogyodaigaku Kenkyu Hokoku (Rikohen), No. 21, pp. 115–122 1976.

*Primary Examiner*—Helane Myers

*Attorney, Agent, or Firm*—Estelle C. Bakun; Linda M. Scuorzo

[57] ABSTRACT

The present invention relates to a continuous in-situ process for the removal from heavy oils, of organically bound sulfur in the form of mercaptans, sulfides and thiophenes, heteroatoms selected from the group consisting of nitrogen and oxygen and metals selected from the group consisting of nickel, vanadium and iron, comprising the steps of (a) contacting a heavy oil with aqueous sodium hydroxide at a temperature of about 380° to about 450° C. for a time sufficient to form sodium sulfide; (b) contacting said sodium sulfide of step (a) with water and a transition metal for a time and at a temperature sufficient to form transition metal sulfide, sodium hydroxide, hydrogen and impurities; and (c) recirculating said sodium hydroxide from step (b) to step (a) and removing said transition metal sulfide and said impurities, wherein said impurities are iron, vanadium and nickel. Optionally, molecular hydrogen may be added in the first step. The present invention is useful in removing organically bound sulfur that has been recognized to be difficult to remove, such as thiophenes. Beneficially, the process also removes other heteroatoms (nitrogen and oxygen) and metals (vanadium, iron, nickel) and reduces asphaltene content (n-heptane insolubles), micro concarbon residue, coke, 975° F. fractions, TGA fixed carbon, average molecular weight, density and viscosity.

8 Claims, No Drawings

CONTINUOUS IN-SITU PROCESS FOR UPGRADING HEAVY OIL USING AQUEOUS BASE

FIELD OF THE INVENTION

The present invention is directed toward a continuous in-situ process for desulfurizing heavy oils, bitumen, tar sands, and other residuum feeds and regenerating the desulfurizing agent.

BACKGROUND OF THE INVENTION

The quality of residuum feeds, particularly bitumen (heavy oil), suffers from high levels of heteroatoms (nitrogen, oxygen and sulfur) and metals (nickel, vanadium and iron). Refining and/or conversion of such sulfur-laden crudes is costly due to the hydrogen needed to remove the sulfur. As environmental pressures continue to lower allowable emission levels in mogas and diesel products, refining costs continue to rise.

Penalty costs for sulfur-laden feeds in refineries can be exorbitant. Hence, desulfurization of such feeds has become a critical target. Thus, there is a need for low-cost processes which upgrade oils to more environmentally friendly and more profitable feedstocks.

Much work has been done utilizing molten caustic to desulfurize coals. For example, see "Molten Hydroxide Coal Desulfurization Using Model Systems," Utz, Friedman and Soboczenski, 51–17 (Fossil Fuels, Derivatives, and Related Products, ACS Symp. Serv., 319 (Fossil Fuels Util.), 51–62, 1986 CA 105(24):211446Z); "An Overview of the Chemistry of the Molten-caustic Leaching Process," Gala, Hemant, Srivastava, Rhee, Kee, Hucko, and Richard, 51–6 (Fossil Fuels, Derivatives and Related Products), Coal Prep. (Gordon & Breach), 71-1-2, 1–28, 1989 CA112(2):9527r; and Base-catalyzed Desulfurization and Heteroatom Elimination from Coal-model Heteroaromatic Compounds," 51–17 (Fossil Fuels, Derivatives, and Related Products, Coal Sci. Technol., 11 (Int. Conf. Coal Sci., 1987), 435–8, CA 108(18):153295y).

Additionally, work has been done utilizing aqueous caustic to desulfurize carbonaceous material. U.S. Pat. No. 4,437,980 discusses desulfurizing, deasphalting and demetallating carbonaceous material in the presence of molten potassium hydroxide, hydrogen and water at temperatures of about 350° to about 550° C. U.S. Pat. No. 4,566,965 discloses a method for removal of nitrogen and sulfur from oil shale with a basic solution comprised of one or more hydroxides of the alkali metals and alkaline earth metals at temperatures ranging from about 50° to about 350° C.

Methods also exist for the regeneration of aqueous alkali metal. See e.g., U.S. Pat. No. 4,163,043 discussing regeneration of aqueous solutions of Na, K and/or ammonium sulfide by contact with Cu oxide powder yielding precipitated sulfide which is separated and re-oxidized to copper oxide at elevated temperatures and an aqueous solution enriched in NaOH, KOH or $NH_3$. Romanian patent RO-101296-A describes residual sodium sulfide removal wherein the sulfides are recovered by washing first with mineral acids (e.g., hydrochloric acid or sulfuric acid) and then with sodium hydroxide or carbonate to form sodium sulfide followed by a final purification comprising using iron turnings to give insoluble ferrous sulfide.

What is needed in the art is a continuous in-situ process for removal of organic sulfur, bound as sulfides, mercaptans and/or thiophenes, which further allows for recovery and regeneration of the desulfurizing agent.

SUMMARY OF THE INVENTION

The instant invention is directed toward a continuous in-situ process for the removal of sulfur from organically bound sulfur containing species existing as mercaptans, sulfides and thiophenes. The process also results in the removal of heteroatoms such as nitrogen and oxygen. In addition, the process results in the removal of metals such as iron, and also vanadium and nickel, from organically bound metal complexes, e.g., the metalloporphyrins.

One embodiment of the present invention is directed toward a continuous in-situ process for the removal from heavy oils, of organically bound sulfur in the form of mercaptans, sulfides and thiophones, heteroatoms selected from the group consisting of nitrogen and oxygen and metals selected from the group consisting of nickel, vanadium and iron, comprising the steps of:

(a) contacting a heavy oil with aqueous sodium hydroxide at a temperature of about 380° to about 450° C. for a time sufficient to form sodium sulfide;

(b) contacting said sodium sulfide of step (a) with water and a transition metal for a time and at a temperature sufficient to form transition metal sulfide, sodium hydroxide, hydrogen and impurities; and (c) recirculating said sodium hydroxide of step (b) to step (a) and removing said transition metal sulfide and said impurities, wherein said impurities are nickel, vanadium and iron.

Preferably, the process is utilized to remove organically bound sulfur existing as thiophones. As used herein, contacting includes reacting.

DETAILED DESCRIPTION OF THE INVENTION

Applicants have found that aqueous hydroxides are capable of removing organically bound sulfur, existing as mercaptans, sulfides and thiophenes, from heavy oils such as bitumen and tar sands and other sulfur containing feedstocks. Other upgrading effects observed with the instant aqueous base treatment include reductions in asphaltene content (n-heptane insolubles), micro concarbon residue (MCR), coke, 975F+ fractions, TGA fixed carbon, average molecular weight by vapor pressure osmometry (VPO), density and viscosity. Applicants believe that the presence of water during desulfurization reduces the amount of heavier end materials (such as asphaltenes and other coking precursors measured by Micro Carbon Residue (MCR)) by acting as a medium which inhibits undesirable secondary reactions which lead to coke formation (such as addition reactions of radicals, formed via thermal cracking, to aromatics forming heavy-end, low value products). Heavy oils as used herein includes vacuum resids, atmospheric resids, heavy crudes where >50% of the components of such crudes boil at 1050° F. and higher, and high sulfur crudes containing >0.5% of sulfur.

The addition of aqueous hydroxide, e.g., NaOH, allows for the initial product from the desulfurization step (NaHS) to further react with another NaOH to form $Na_2S$ and $H_2O$.

The concentration of aqueous hydroxide in water added to the sulfur containing feedstock will range from about 5 wt. % to about 60 wt. %, preferably about 20 wt. % to about 50 wt. % based on the weight of the feedstock. Such concentrations provide a mole ratio of about 2:1 to about 4.5:1 alkali metalhydroxide:sulfur. Although a one-time reaction of the aqueous hydroxide with the feedstock is sufficient, subsequent treatments of the feedstock with additional aqueous hydroxide can be performed.

The hydroxide and feedstock will be reacted at a temperature of about 380° C. to about 450° C., preferably the temperature will be between 400° to 425° C. The reaction time will be at least about 5 minutes to about three hours. Preferably, the reaction time will be about one-half to one and one-half hours. Temperatures of at least 380° C. are necessary to remove organically bound sulfur which exist as mercaptans, sulfides and thiophenes. Such sulfur compounds are not removed by the prior art utilizing molten NaOH because reaction temperatures are too low to affect such organically bound sulfur moieties. Preferably, reaction temperatures are maintained at or below about 425° C. for treatment times of less than 90 minutes to further prevent excessive cracking reactions from occurring.

In a preferred embodiment of the invention, molecular hydrogen will be added to the aqueous hydroxide system. from about 50 psi (345 kPa) to about 700 psi (4825 kPa), preferably about 200 psi (1380 kPa) to about 500 psi (3450 kPa) (cold charge) of the initial feed charge. Alternatively, hydrogen donor solvents (e.g., tetralin) can be added as a source of hydrogen or to supplement molecular hydrogen.

The present invention not only removes organically bound sulfur from the feedstocks but advantageously also removes vanadium, iron, nickel, nitrogen, and oxygen. The iron, nickel, and vanadium are removed as impurities along with the transition metal sulfide formed during the process. The invention is capable of removing 50 percent or more of such organically bound sulfur from the sulfur containing feedstock. In addition, significant conversion of these heavy oils to lighter materials is evidenced by observed reductions in average molecular weight, MCR contents, 975° F. and higher boiling fractions, asphaltene contents, density, and viscosity. Whereas, treatments without sodium hydroxide present generate more gas and solids formation (less oil) and increase overall MCR values.

The heavy oil feedstocks (sulfur-containing feedstocks) which can be desulfurized in accordance with the present invention include any feedstock containing organically bound sulfur, which exist as mercaptans, sulfides and/or thiophenes, such as bitumen, tar sands, heavy crude oils, refinery products with high sulfur levels, and petroleum resid.

Applicants believe that, by way of example, the process of desulfurizing benzo[b]thiophenes follows scheme 1.

Scheme 1:

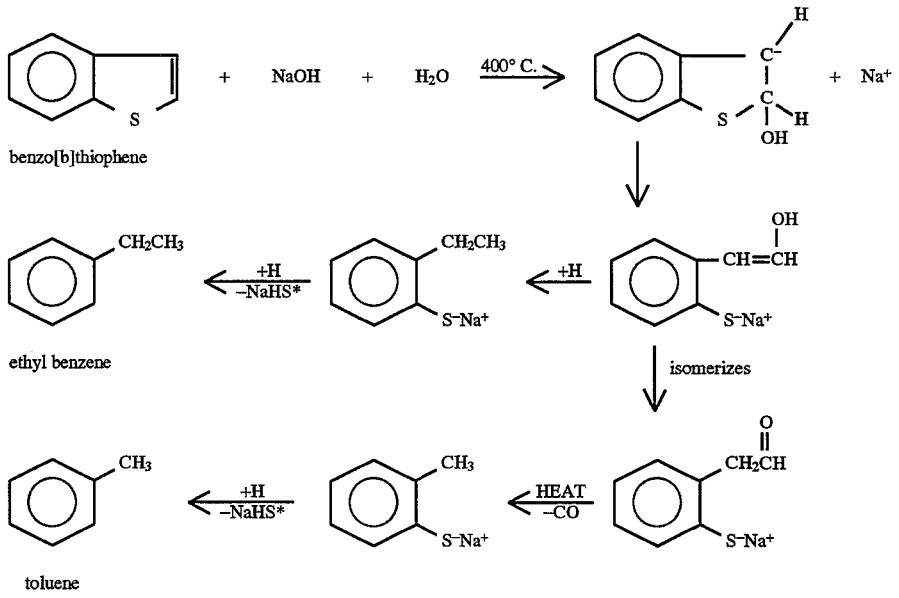

*Note: The initially generated sodium hydrosulfide (NaHS) in the presence of sodium hydroxide and water is converted to sodium sulfide ($Na_2S$):

$$NaHS \xrightarrow{NaOH} Na_2S + H_2O$$

Such hydrogen addition aids in the removal of the initially formed organic sulfide salt ($RS^-Na^+$ wherein R is an organic group in the oil), resulting in enhanced selectivity to sulfur-free products. The pressure of the hydrogen added will be Thus, hydrogen addition can be utilized to selectively form ethylbenzene if desired. Likewise, heat can be utilized to selectively produce toluene.

Once the sodium hydroxide treatment has been concluded, the sodium sulfide generated is then treated in one of two ways. The $Na_2S$ can be heated in the presence of a transition metal for a time and at a temperature sufficient to form a metal sulfide, sodium hydroxide and molecular hydrogen. Alternatively, sodium hydroxide can be regenerated via steam stripping and removing the sulfur as hydrogen sulfide gas.

When sodium hydroxide is regenerated, via the transition metal route, the metals are reacted with the sodium sulfide at a temperature of about 380° C. to about 425° C., preferably about 400° C. to about 425° C. The reaction will be carried out at about 400° C. to about 425° C. for treatment times between 30 minutes and 2 hours.

Applicants believe that the chemical pathway for the instant process, where iron has been chosen as the transition metal, follows the equation below.

$$2Na_2S+4H_2O+Fe^o \rightarrow FeS_2+4NaOH+2H_2$$

different sulfur moieties found in Alberta tar sands, bitumen and heavy oils. The experimental conditions include a temperature range of from about 400° C. to about 425° C. for 30 to 120 minutes. After the organic sodium sulfide salt is formed, the sulfur is removed from the structure as sodium hydrosulfide (which reacts with another sodium hydroxide to generate sodium sulfide and water). Additional experiments showed that the addition of a hydrogen donor solvent (e.g., tetralin) or molecular hydrogen to the aqueous base system aids in the removal of the initially formed salt as sodium hydrosulfide. Identical treatment of model compounds without base showed no reactivity. These controls were carried out neat (pyrolysis) and in the presence of water at 400° C. for two hours. All results are shown in Table 1.

TABLE 1

Aqueous Sodium Hydroxide Treatments of Benzo[b]thiophene (B[b]T) (1.0 g B[b]T, 6.09 Aqueous NaOH)

| | Toluene | Ethyl Benzene | % Conversion[1] | % Selectivity[2] | % Heavy End[3] |
|---|---|---|---|---|---|
| 400° C./2 Hrs. (2 egs.* NaOH) | | | | | |
| Aq. NaOH | 9.9 | 5.1 | 89.3 | 23.2 | 4.1 |
| Aq. NaOH + tetralin | 28.2 | 14.6 | 88.8 | 52.5 | 3.0 |
| Aq. NaOH + $H_2$ (700 psig (4825 kPa) cold) | 39.1 | 57.5 | 99.8 | 98.6 | 0.3 |
| 400° C./1 Hr. (no hydrogen) | | | | | |
| Aq. NaOH (1.5 eqs.*) | 4.0 | 1.8 | 89.1 | 10.9 | 2.4 |
| Aq. NaOH (2.7 eqs.*) | 57.0 | 19.0 | 82.0 | 95.1 | 0.3 |

Notes: Benzo[b]thiophene showed no reaction when treated in neutral water and no reaction under neat (pyrolysis) conditions.
[1]% Conversion = 100% − % benzo[b]thiophene present.
[2]% Selectivity = % of products as S-free products.
[3]% Heavy Ends = % products greater in molecular weight than benzo[b]thiophene.
*eqs. = molar equivalents The metals which can be utilized to desulfurize aqueous sodium sulfide include iron, cobalt, or other effective metals which will yield a metal sulfide and sodium hydroxide when reacted with $Na_2S$, and mixtures thereof. The greater the surface area of the metal, the greater the conversion and selectivity to NaOH. Therefore, the metal will preferably have a particle size of 38 to about 1200 microns, most preferably, the metal powder will have a particle size of about 50 to 150 microns. The stoichiometry dictates that at least 1 mole iron, for example, must exist for every 2 moles of sodium sulfide.

If steam stripping is chosen to regenerate the sodium hydroxide, the reaction can be carried out at temperatures of about 150° C. to about 300° C., for reaction times sufficient to remove the hydrogen sulfide. Reaction times are easily determined by one skilled in the art.

Once the sodium hydroxide is regenerated, it is recycled with the generated hydrogen and utilized for removing organically bound sulfur existing as mercaptans, sulfides and thiophenes from heavy oil feedstocks.

The following examples are for illustration and are not meant to be limiting.

The following examples illustrate the effectiveness of aqueous hydroxide systems in removing sulfur from model compounds. The compounds used are representative of the Autoclave experiments on heavy oils (bitumen) from both the Athabasca and the Cold lake regions of Alberta, Canada, demonstrate the ability of aqueous base treatments in the preferred temperature range (400° to 425° C.) to remove over 50% of the organic sulfur in the oils (Table 2). The sulfur in these oils are known to exist primarily as sulfides (27–30%) and thiophenes (70–73%). The greater than 50% desulfurization indicates that thiophenic sulfur moieties are affected by the treatment as well as the relatively weaker C-S bonds in certain sulfides (aryl-alkyl and dialkyl). Other beneficial effects of the treatment include reduction of the vanadium and iron to below detectable levels and almost 75% removal of the nickel. The levels of nitrogen are reduced as well as the contents of coke-precursor materials (heavy-end generation) as measured by MCR (Micro Carbon Residue) content. Additional evidence of reduced heavy-end materials exists in the asphaltene contents (measured as n-heptane insoluble materials) and average molecular weight (MW). The density and viscosity of the treated oils are also significantly lower. The observed increase in atomic H/C ratio illustrates that hydrogen has been incorporated into the products, which is expected based on the chemistry shown from the model compound studies.

In the absence of base, treatments carried out with only hydrogen added and also with only water and hydrogen added show that only 26% of the native sulfur is removed under the same temperature conditions (Table 3). The sulfur is removed as hydrogen sulfide gas produced from thermal cracking at these temperatures. The sulfur recovered from the aqueous sodium hydroxide treatments is recovered as sodium sulfide with no hydrogen sulfide generation.

Treatments carried out with aqueous base at lower temperatures (350° C.) show that only 14.2% of the sulfur is removed (S/C ratio of 0.0193 from 0.0225) on another Cold Lake bitumen sample. At 400° C., the same sample treated under the same conditions was reduced only by 13.3% in only water and by 35.1% in the presence of aqueous sodium hydroxide.

to saturate the double bond of the intermediate vinyl alcohol. Without hydrogen present, more isomerization occurs to the aldehyde, which decarbonylates to yield toluene from benzo [b]thiophene.

Table 4 shows the data obtained for these reactions carried out without external hydrogen added (400° C. for 60 minutes). The data show that the addition of iron or cobalt increases the level of desulfurization and the selectivity to ethyl benzene. This is evidence that NaOH is generated as well as molecular hydrogen. Both conversion and selectivity also appear to be a function of the surface area of the metal, in that the more exposed the metal surface, the more reaction to yield NaOH and hydrogen.

TABLE 2

Autoclave Treatments of Alberta Bitumens With Aqueous Sodium Hydroxide* for 90 minutes (500 psig (3450 kPa) Hydrogen, cold charge)

| | Athabasca(1) (1:4, water:bitumen) | | | Cold Lake(2) (1:5, water;bitumen) | | |
|---|---|---|---|---|---|---|
| | Untreated | Treated | | Untreated | Treated | |
| P at 400° C., psig (kPa) | — | 1680 | (11,582) | — | 1758 | (12,120) |
| P at 425° C., psig (kPa) | — | 1834 | (12,644) | — | 2030 | (13,995) |
| S/C Ratio | 0.0240 | 0.0108 | | 0.0184 | 0.00917 | |
| % Desulfurization | — | 55.0 | | — | 50.2 | |
| H/C Ratio | 1.441 | 1.506 | | 1.536 | 1.578 | |
| N/C Ratio | 0.00528 | 0.00337 | | 0.00400 | 0.00321 | |
| % Denitrogenation | — | 36.2 | | — | 19.8 | |
| Metals (ppm) | | | | | | |
| Vanadium | 216 | <10 | | 160 | <12.5 | |
| Nickel | 88 | 25 | | 62 | 15 | |
| Iron | 855 | 0.7 | | <9.5 | <12.5 | |
| % MCR | 14.0 | 6.9 | | 12.7 | 4.9 | |
| % Asphaltenes | 14.2 | 5.3 | | 11.2 | 2.1 | |
| Molecular Weight | 607 | 268 | | 473 | 257 | |
| Density (22° C.) | 1.026 | 0.936 | | — | — | |
| Viscosity (25° C., centipoise) | >500,000 | 10.5 | | 468 | 7.9 | |

*1.8 fold molar excess of NaOH used
(1)66.49 bitumen, 15.0 g water, 20.0 g NaOH
(2)70.59 bitumen, 15.0 g water, 20.0 g NaOH

TABLE 3

Autoclave Treatments of Athabasca Bitumen at 425° C. for 90 minutes (500 psig (3450 kPa) Hydrogen, cold charge)

| | Untreated | Hydrogen(1) | Water/Hydrogen(2) | NaOH*/Water/Hydrogen(3) |
|---|---|---|---|---|
| % Gas Make | — | 3.8 | 4.6 | 1.6 |
| % Solids Formed | — | 18.1 | 22.1 | 6.5 |
| Net Effects (including solids) | | | | |
| % MCR | 14.0 | 18.5 | 14.9 | 10.1 |
| % Desulfurization | — | 26.2 | 25.5 | 49.1 |

*1.7 fold molar excess of NaOH used
(1)78.40 g bitumen
(2)69.29 bitumen, 25.0 g water
(3)66.4 g bitumen, 15.0 g water, 20.0 g NaOH Benzo[b]thiophene (B[b]T) was subjected to a series of treatments with aqueous sodium sulfide. This was in an effort to generate NaOH and hydrogen in-situ to then do the NaOH desulfurization observed to occur via the pathways shown in Scheme 1. Those systems showed that in the presence of added molecular hydrogen or hydrogen donor solvents (e.g., tetralin), there was more of an abundance of ethyl benzene over toluene due to the ability of the hydrogen Table 5 provides some additional data using NaOH to treat benzo[b]thiophene. The addition of iron powder increased the levels of both conversion and selectivity indicating that some regeneration of the NaOH occurred in-situ to further desulfurize the compound. The accompanying increases in ethyl benzene to toluene ratio indicates that some hydrogen was present as well. Comparative data is provided for how effective the desulfurization can be when external hydrogen is added.

TABLE 4

Aqueous Sodium Sulfide Treatments of Benzo[b]thiophene (B[b]T) (400° C., 1 hr., 0.4 g B[b]T, 3.0 g 10% Aqueous $Na_2S$, 0.2 g metal)

| | Additive | | | |
|---|---|---|---|---|
| | None | Fe filings | Fe powder | Co powder |
| Percent | | | | |
| Benzo[b]thiophene | 68.7 | 58.9 | 43.3 | 14.7 |
| Toluene | 3.8 | 6.1 | 5.3 | 4.8 |
| Ethyl benzene | 5.5 | 13.9 | 25.7 | 7.2 |
| Phenol | 0.2 | | 0.2 | 0.5 |
| o-ethyl phenol | 0.2 | | 0.1 | 0.6 |
| o-ethyl thiophenol, sodium salt | 5.9 | 4.1 | 3.2 | 24.1 |
| o-ethyl thiophenol, sodium salt | 11.1 | 14.5 | 18.8 | 44.8 |
| "Heavy Ends" (products higher in MW than B[b]T) | 1.7 | 1.1 | 1.7 | 1.9 |
| Conversion | 31.3 | 41.1 | 56.7 | 85.3 |
| Selectivity | 31.6 | 48.9 | 55.4 | 15.4 |

TABLE 5

Aqueous Sodium Hydroxide Treatments of Benzo[b]thiophene (B[b]T) (400° C., 1.0 hr., 3.0 g 10% Aqueous NaOH, 0.4 g B[b]T)

| | Additive | | |
|---|---|---|---|
| | None | Fe powder* | Hydrogen** |
| Percent | | | |
| benzo[b]thiophene | 10.9 | 5.9 | 0.2 |
| toluene | 4.0 | 7.7 | 39.1 |
| ethyl benzene | 1.8 | 7.1 | 57.5 |
| phenol | 2.2 | 0.5 | <0.1 |
| o-ethyl phenol | 1.7 | 0.9 | 0.4 |
| o-methyl thiophenol, sodium salt | 47.7 | 33.3 | <0.1 |
| o-ethyl thiophenol, sodium salt | 27.4 | 42.0 | <0.1 |
| "heavy ends" (products higher in MW than B[b]T) | 2.4 | 2.0 | 0.3 |
| Conversion | 89.1 | 94.1 | 99.8 |
| Selectivity | 10.9 | 17.2 | 98.6 |

*0.2 g Fe Powder used
**700 psig (4825 kPA) $H_2$ (cold charge)

Table 6 compares the instant invention using aqueous caustic and molten caustic (as is used in the prior art) when used on Athabasca bitumen:

TABLE 6

| | | 425° C. for 60 minutes | |
|---|---|---|---|
| | Untreated | Molten | 4.4:1, Bitumen:Water |
| Atomic H/C Ratio | 1.441 | 1.420 | 1.515 |
| Atomic S/C ratio | 0.0257 | 0.0120 | 0.0126 |
| % Desulfurization | — | 53.3 | 51.0 |
| TGA Data | | | |
| % 975 F+ | 62.2 | 30.5 | 16.1 |
| % Fixed Carbon | 7.1 | 9.9 | 5.0 |
| % Coke | 9.2 | 11.6 | 6.6 |
| % MCR (wt. %) | 13.97 | 15.71 | 8.97 |

As the data show, while similar desulfurization levels are achieved, damaging thermal effects are evident only in the absence of water. With water present, the quality of the product oil is significantly higher. All of the indicators for thermal effects (H/C, MCR, TGA) support this.

What is claimed is:

1. A continuous in-situ process for the removal from heavy oils, of organically bound sulfur in the form of mercaptans, sulfides and thiophenes, heteroatoms selected from the group consisting of nitrogen and oxygen and metals selected from the group consisting of nickel, vanadium and iron, comprising the steps of:

(a) contacting a heavy oil with aqueous sodium hydroxide at a temperature of about 380° to about 450° C. for a time sufficient to form sodium sulfide;

(b) contacting said sodium sulfide of step (a) with water and a transition metal for a time and at a temperature sufficient to form transition metal sulfide, sodium hydroxide, hydrogen and impurities; and (c) recirculating said sodium hydroxide from step (b) to step (a) and removing said transition metal sulfide and said impurities, wherein said impurities are iron, vanadium and nickel.

2. The method according to claim 1 wherein molecular hydrogen is added to step (a).

3. The method according to claim 1 wherein a hydrogen donor solvent is added to step (a).

4. The method according to claim 1 wherein step (b) is conducted at a temperature of about 380° C. to about 425° C. and for about 0.5 to about 2 hours.

5. A method according to claim 1 wherein said transition metal is selected from the group consisting of iron, cobalt and mixtures thereof.

6. A method according to claim 4 wherein said transition metal has a particle size of about 38 to about 1200 microns.

7. A method according to claim 3 wherein said hydrogen donor is tetralin.

8. A method according to claim 2 wherein the pressure of molecular hydrogen added is about 345 kPa to about 4825 kPa.

* * * * *